US005218953A

United States Patent [19]

Shimek et al.

[11] Patent Number: 5,218,953

[45] Date of Patent: Jun. 15, 1993

[54] VARIABLE HIGH EFFICIENCY GAS BURNING FIREPLACE

[76] Inventors: Ronald J. Shimek; Daniel C. Shimek, both of 6665 W. Hwy. 13, Savage, Minn. 55378

[21] Appl. No.: 817,082

[22] Filed: Jan. 6, 1992

[51] Int. Cl.[5] ..... F23L 7/00

[52] U.S. Cl. ..... 126/512; 126/516; 126/521; 126/85 B

[58] Field of Search ..... 126/512, 516, 521, 85 B; 431/20

[56] References Cited

U.S. PATENT DOCUMENTS 4,204,832 5/1980 Miller ..... 431/20
4,340,355 7/1982 Nelson et al. ..... 431/20
4,545,360 10/1985 Smith et al. ..... 126/521 X
4,793,322 12/1988 Shimek et al. ..... 126/85 B
5,076,254 12/1991 Shimek et al. ..... 126/512

*Primary Examiner*—Larry Jones
*Attorney, Agent, or Firm*—John B. Sowell

[57] ABSTRACT

A standard prefabricated direct vented fireplace is designed for mass production on an assembly line where it is fitted with a plurality of different side walls or doors and optional heat exchangers for effecting different thermal efficiencies. The fireplace is factory adjusted for optimum burner efficiency under standard installation conditions. An induced draft fan/blower is installed in the path of the exhaust gasses and is provided with an in field adjustable variable speed control to overcome exceptionally high draft loss or long intake or exhaust passageways and to again optimize the burner efficiency after field installation.

13 Claims, 2 Drawing Sheets

VARIABLE HIGH EFFICIENCY GAS BURNING FIREPLACE

BACKGROUND OF THE INVENTION

1. Field of the Invention

The present invention relates to high efficiency gas burning fireplaces. More particularly, the present invention relates to a prefabricated fireplace designed to be mass produced and used at various levels of thermal efficiency while maintaining an optimum burner efficiency.

2. Description of the Prior Art

Heretofore, prior art gas burning fireplaces were designed to burn fuel at one or more fixed burn rates, only one of which was set for highest burner efficiency at the factory Several important factors that determine burner efficiency are fuel to air ratio, the temperature in the combustion chamber and the time the mixture is allowed to burn before being exhausted from the fireplace.

Our U.S. Pat. No. 4,793,322 shows and describe a direct vented gas fireplace which has a high thermal efficiency and an optimum fuel to air mixture which result in very low emission of CO and $NO_x$. The heat produced in the combustion chamber is sufficient to create hot exhaust gases that are directed through a relatively short exhaust passageway which terminates in a short horizontal exhaust stack. The exhaust gases generate a suction on the combustion chamber which draws fresh air for combustion into the combustion chamber. Once the combustion air inlets are designed for an optimum burn rate, the system will maintain a very efficient burn rate over a range of gas burning rates so long as the combustion chamber maintains a high combustion temperature and nothing is done which would change the differential pressure drop across the combustion chamber. It is well known that lengthening the exhaust passageway and exhaust stack and/or lengthening the intake passageway used to supply fresh combustion air will change the differential pressure drop across the combustion chamber, thus, will also change and effect the optimum burner efficiency and the thermal efficiency of the fireplace system.

Our U.S. Pat. No. 5,016,609 shows and describes another zero clearance fireplace which was designed to provide an efficient gas burner system in a fireplace having up to three airtight glass sidewalls and also provide an efficient heating system for rooms and/or small apartments or condominiums. Once the inlets and outlets to and from the combustion chamber were fixed, there was no provision to further fine tune the optimum burner efficiency in the field.

When zero clearance fireplaces of the type shown in the above mentioned prior art patents are placed in intake and/or exhaust environments other than substantially the exact environment for which they were designed and/or calibrated, the optimum burner efficiency is affected as a result of the field environment.

When a prefabricated fireplace is designed for its highest possible heating efficiency it is provided with a forced air fan in the heat exchanger and the heat exchanger system is designed for a high recovery of heat from the exhaust gases before they are released to the atmosphere. A high recovery heat exchanger can add substantially to the cost of a prefabricated fireplace. Such cost may easily be justified in locations which have a very high degree-day heating season, but is not easily justified in low degree day parts of the world such as California, the south and southwest and areas that have a mediterranean climate.

People living in such warm climate areas may desire a prefabricated fireplace with a decorative gas burner log system and may not desire air tight glass side walls, but may desire a more realistic wood burning fireplace effect that is presented by glass panel doors that have handles and may be physically opened.

Most prefabricated fireplaces are either purchased by architects/designers for their clients or are sold through distributor/installers that have a very high degree of sophistication concerning both cost and thermal efficiency.

It would be desirable to provide such sophisticated customers with a single base fireplace unit having up to three fixed glass side walls or glass doors which could be fitted with a standard heat exchanger, or a blower heat exchanger or a very high efficiency blower heat exchanger for different intake and exhaust conditions that effect burner efficiency. It would be highly desirable to provide the sophisticated installer with one simple adjustment which would enable setting an optimum burner efficiency after field installation.

SUMMARY OF THE INVENTION

It is a primary object of the present invention to provide a high efficiency gas burning fireplace.

It is another primary object of the present invention to provide a high efficiency gas burning fireplace which is initially factory adjusted for an optimum gas burner efficiency at the time of manufacture for one standard set of conditions.

It is another primary object of the present invention to provide a simple adjustable bypass damper for setting gas burner efficiency at the factory.

It is another primary object of the present invention to provide a variable speed induced draft fan/blower for setting gas burner efficiency in the field for non-standard conditions.

It is another primary object of the present invention to provide a motor speed control for setting the speed of a variable speed induced draft fan/blower for setting gas burner efficiency in the field.

It is another principal object of the present invention to provide a plurality of means for setting gas burner efficiency after a standard fireplace is custom fitted with different heat exchangers, side walls, exhaust and intake passageways which effect the differential pressure drop across the combustion chamber.

It is another principal object of the present invention to provide a gas burning fireplace which was designed to meet all presently proposed standards for pollution and gas burner efficiency.

According to these and other objects of the present invention, there is provided a standard prefabricated, direct vented fireplace which is preferably produced on a mass production assembly line and fitted with a plurality of optional side walls and optional heat exchangers of different thermal efficiency. An adjustable bypass/baffle is provided in the intake combustion air passageway for adjusting the burner efficiency of the various fireplace systems at the factory and the fireplace is provided with an adjustable variable speed induced draft fan/blower in the exhaust passageway for adjusting the burner efficiency of the fireplace systems which have exceptionally high loss or long intake or exhaust passageways.

DESCRIPTION OF THE PREFERRED EMBODIMENT

Figure 1:
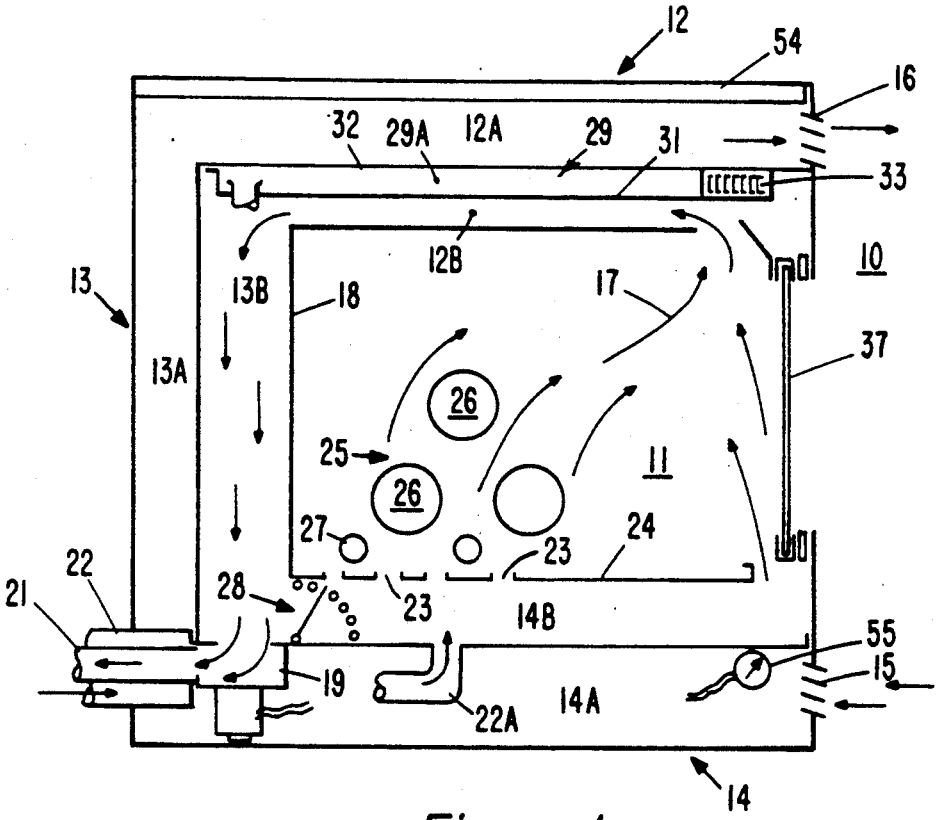
FIG. 1 is a schematic drawing in side elevation and section view showing a preferred embodiment fireplace with an enclosed induced draft fan/blower.

Refer now to FIG. 1 showing a schematic drawing in side elevation and section view of a preferred embodiment fireplace 10 having a centrally located combustion chamber 11 inside of the top wall 12, the rear wall 13 and bottom wall 14. Top wall 12 comprises an outer plenum 12A and an inner plenum 12B. Rear wall 13 comprises an outer plenum 13A and an inner plenum 13B. Bottom wall 14 comprises an outer plenum 14A and an inner plenum 14B. The outer plenums 12A, 13A and 14A are interconnected to form a U-shaped heat exchanger wherein air entering at bottom entrance 15 is exhausted out the upper exit 16. As will be explained, the heat exchange efficiency may be enhanced by the addition of a circulating blower in one of the outer plenums In the preferred embodiment of the present invention, the exhaust gases 17 exiting the combustion chamber pass through inner plenum 12B of top wall 12 and preferably enter the plenum at the front so as to create an elongated passageway which is connected to the inner plenum 13B of the rear wall 13 which passes behind the rear panel 18 of the combustion chamber 11. Hot exhaust gases are shown entering a novel induced draft fan/blower 19 which directs the exhaust gases directly into an exhaust pipe 21 preferably to the open atmosphere when the fireplace 12 is installed against a rear wall in a zero clearance configuration. In the preferred embodiment of the present invention only one hole is cut through the rear wall (not shown) and a coaxial pipe is installed therethrough wherein the outer pipe 22 is nested around the hot exhaust pipe 21 so as to preheat the outside air entering through the intake pipe 22 which is conducted to the intake plenum 14B via intake pipe 22A. Fresh combustion air thus enters plenum 14B where it is sucked or drawn through a plurality of apertures 23 provided in the bottom panel 24 which is directly below and supports the burner system 25 comprising artificial gas logs 26 and a gas burner 27 which is connected to a source of natural gas through appropriate pressure regulating valves, safety valves, and other gas line feeding system elements (not shown). The present invention includes air baffle means 28 shown diagrammatically as a pivoted damper having a plurality of selectable positions which permits some of the fresh air in the plenum 14B to be diverted around the damper and drawn into the inlet of the induced draft fan 19. The purpose of the diagrammatic showing of the damper 28 is to illustrate that when the fireplace 10 is set for optimum burner efficiency at the factory the induced draft fan 19 is set at a mid-range exhaust rate of four cubic feet per minute. The damper 28 is then set at the factory so that the burner system in the combustion chamber is completely optimized at the desired burning rate. In the preferred embodiment of the present invention, there is no pivoted damper 28 but a plate with a calibrated orifice or slot is attached across the end of the plenum 14B. Knowing which different side walls have been attached to the fireplace 10 and knowing the desired burning rate for the fireplace, a precalibrated plate 28 (not shown) may be inserted across the end of plenum 14B to achieve the desired optimum burner efficiency of the burner system. The burner efficiency is determined under ideal test conditions at the factory and does not require testing each individual unit once the parameters have been tested and set.

In the preferred embodiment of the present invention, a high efficiency heat exchanger 29 in the form of a panel 31 may be attached to the top panel 32 of the top wall of the combustion chamber which creates a passageway 29A in which the air from the room to be heated is introduced through an intake or grill 33 and this preheated air is directed to the outer plenum 14A of the heat exchanger as will be explained in more detail hereinafter.

Figure 2:
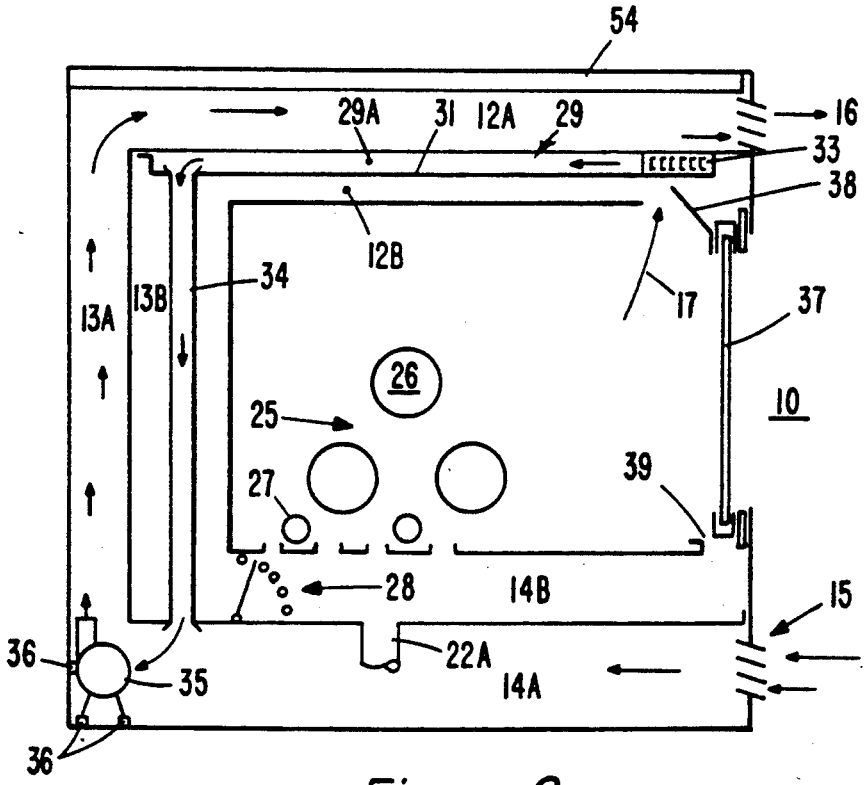
FIG. 2 is a schematic drawing in side elevation and section view of the fireplace of FIG. 1 showing a high efficiency heat exchanger having an air circulation blower enclosed in the outer heat exchanger.

Refer now to FIG. 2 showing a schematic drawing in side elevation and section view of the fireplace of FIG. 1. The fireplace 10 is identical to the fireplace of FIG. 1 and the elements in FIG. 1 shown in FIG. 2 are numbered identically to the FIG. 1 embodiment and do not require additional explanation herein. The purpose of FIG. 2 is to show in greater detail the high efficiency heat exchanger 29 which takes in room air through the grill or intake 33 and directs it through the heat exchanger plenum 29A along the hot top panel 31 of the combustion chamber 11 and into a plurality of vertical heat exchanger tubes 34 in the manner of a fire tube boiler. The preheated air passing through vertical tubes 34 enters into the outer plenum 14A in which room air is being drawn and preheated and directed into the inlet of the circulating air blower 35. Blower 35 is preferably attached to the metal side walls of the fireplace 10 by a plurality of magnets 36 to allow for ease of removal or placement therein. The partially preheated air shown entering the intake of the circulating air blower 35 is exhausted into the rear outer plenum 13A where it is further preheated and directed around and into outer plenum 12A where it is preheated further before being exhausted out the top exit 16. The glass side wall or door panel 37 is shown diagrammatically mounted on the front wall of the fireplace 10 and is provided with a diversionary panel 38 which assists in directing the inlet air which enters the air wash inlet 39 to sweep across the inner surface of the glass door or panel 37 thus providing a cleansing action before being exhausted with the exhaust gases 17. The exhaust gases 17 as explained hereinbefore are directed through the inner plenum 12B and down through the inner plenum 13B of the rear wall 13, thus heating the heat exchange tubes 34, before being drawn into the inlet of the induced draft fan/blower 19 as explained hereinbefore.

As explained in the summary of the invention not every customer desires more than one glass door or panel 37. Further, not every customer can justify the cost of the high efficiency heat exchanger 29 which comprises the vertical heat exchanger tubes 34 and in some cases cannot even justify the circulating air blower 35. Customers buying the novel fireplace 10 that reside in California and Florida may have fewer than 30 days in an average season when they need to obtain heat from the fireplace system 10, thus cannot easily justify the cost of the enhanced heating exchanger system. However, every customer desires, and the EPA demands, that the gas burner systems produce the lowest possible emissions. The customer also achieves the maximum efficiency for the fuel burned when these conditions are met.

Figure 3:
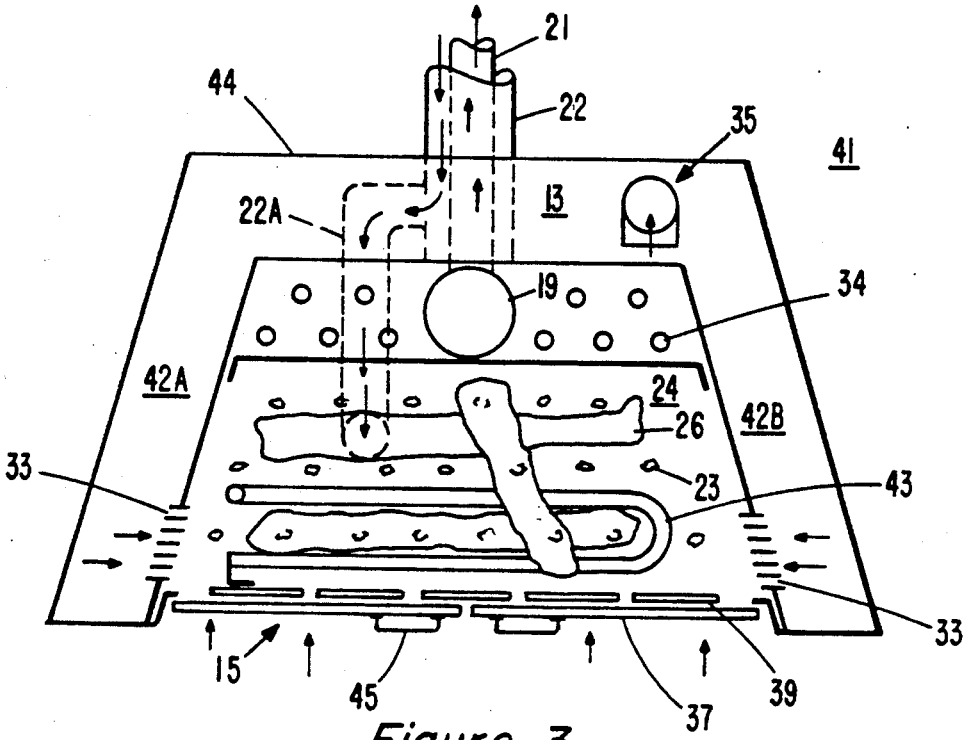
FIG. 3 is a schematic drawing in top plan view and section of a typical preferred embodiment fireplace with only one glass sidewall and having a high efficiency heat exchanger.

Refer now to FIG. 3 showing a schematic top plan view and section of a typical preferred embodiment fireplace which has only one glass side wall or door panel 37. It will be noted that the fireplace is a tapered trapezoid designed to fit into a fireplace enclosure but just as well could be a rectangular box having four side walls, any one of which could be provided with a glass door panel 37 as explained hereinbefore. The purpose of FIG. 3 is to better explain how the high efficiency heat exchanger 29 draws its room air through the grills 33 and into the plenum 29A. The fireplace 41 shown in FIG. 3 has hollow outer plenums 42A and 42B which are interconnected to the bottom outer panel 14A so that room air may be drawn through the bottom entrance 15 and into the outer plenum 14A where it is drawn up through the hollow outer plenums 42A and 42B to permit the room air to be drawn through the grills 33 and into the plenum 29 (not shown) where it is preheated and then directed downward through the vertical heat exchange tubes 34. It will be understood that the preheated air passing through the tubes 34 is dumped into the lower outer plenum 14A as best shown in FIG. 2 before being drawn into the circulating blower 35.

FIG. 3 also shows the exhaust pipe 21 and its outer coaxial pipe 22 through which fresh air is drawn into the inlet pipe 22A which directs its air into the inner plenum 14B which is below the burner system. The burner system 25 is shown comprising artificial logs 26 preferably made from ceramic fibers to permit light weight and fire resistance and enhances the color of the flames being emanated from the burner system U tube 43 which passes between and around in front of the log system 26. The apertures 23 in the bottom panel 24 are preferably shown stagger spaced below and between the artificial logs 26. The air wash inlet 39 is shown as a plurality of elongated slots but may take any other form which maintains the integrity and strength of the bottom panel 24. The placement of the air circulating blower 35 may be anywhere along the back panel 44 of the outer plenum 13A. The induced draft fan 19 is preferably centrally located in the bottom of the inner plenum 13B as best shown in FIG. 1. The handles 45 on the glass panel doors 37 illustrate that some customers desire the aesthetic beauty of a conventional fireplace having pivotable doors which open to burning logs even though they be artificial and are not easily distinguished from the burning of wood logs in a conventional wood burning fireplace. When the fireplace employs pivoting doors, it is difficult to achieve a completely airtight structure as may be achieved by a single glass panel using inner cylindrical rubber seals.

A glass panel is easily sealed and permits no leakage thus is the preferred embodiment system which uses all outside combustion air and prevents any depletion of the warm air from the interior space being heated during cold weather.

Figure 4:
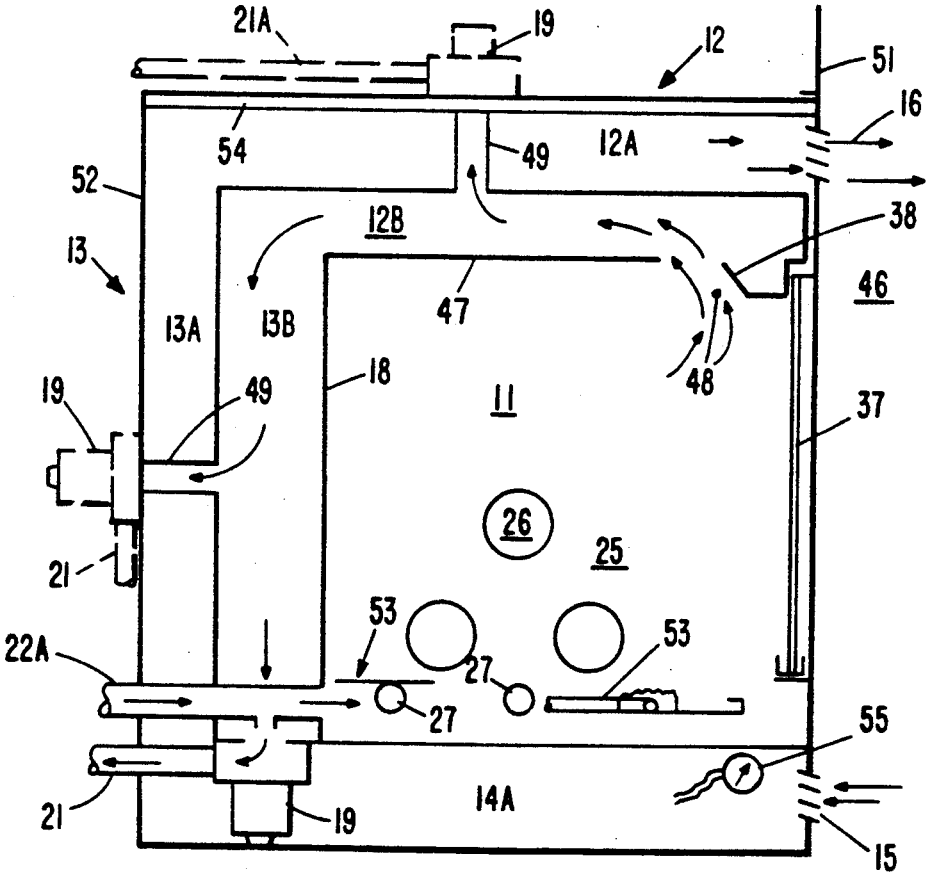
FIG. 4 is a schematic drawing in side elevation and section view of a prior art type fireplace that has been modified to include the principal elements of the present invention.

Refer now to FIG. 4 showing a schematic drawing and side elevation and section view of a prior art type fireplace 46 which has a double plenum upper wall 12 comprising an inner plenum 12B and an outer plenum 12A. Further, the prior art fireplace is provided with a double plenum rear wall 13 having plenums 13A and 13B. The prior art fireplace need not have an inner plenum 14B but must have an outer plenum 14A which interconnects with the outer plenums 13A and 12A to provide the U-shaped heat exchanger which takes in air at the bottom entrance 15 and exhausts the air out of the top exit 16 with or without the aforementioned circulating air blower 35 best shown in FIG. 2. In a prior art type fireplace 46 to be modified, the diverter panel 47 may have its exit passageway 48 close to or abutting rear panel 18 and need not be forward opposite the diversionary panel 38 as shown in a preferred embodiment which creates a more efficient heat exchange between the air being heated in the heat exchanger 12A, 13A, 14A.

When this prior art type fireplace 46 is retrofitted or modified to include a variable speed induced draft fan 19, it may be placed on top of the fireplace 46 with an interconnecting exhaust pipe 49 which continues through the induced draft fan to exhaust through a long exhaust pipe 21A. When the motor 19, shown in phantom lines, is placed on the top wall 12, a decorative panel 51 is placed above the outlet top exit 16 to conceal the induced draft fan motor 19 and provides access thereto when needed.

If the zero clearance fireplace 46 is not placed flush against an outside wall, it is possible to retrofit and install the induced draft fan 19 through the rear panel 52 using the same exhaust pipe 49 which interconnects through the induced draft fan and to the exhaust pipe 21.

Even with the modification of a prior art type fireplace 46, it is most desirable to place the induced draft fan 19 in the bottom inner panel 13B and exhaust the exhaust gases through the exhaust pipe 21 to achieve the maximum heat exchange effect. In this modified fireplace 46 the inlet pipe 22A is shown as a separate pipe which enters the combustion chamber 11 through the rear panel 18 directly into the combustion chamber 11. When the combustion air enters the rear of the combustion chamber, it is desirable to direct the exhaust gases to the front of the combustion chamber to achieve a complete pass through of combustion air. To achieve such complete combustion it is desirable in this case to provide panels 53 which direct some of the combustion air into a preferred location with respect to the burner system 27 to optimize combustion efficiency without producing pollutants such as carbon monoxide and soot. In the preferred embodiment of the present invention, each of the top panels 12 is provided with approximately 1 inch of fiberglass insulation 54 which has a protective cover thereon. Such insulation 54 may be obtained as a rigid board with a metal cover.

Having explained a preferred embodiment of the present invention and showing a modification of a prior art fireplace to include the present invention, it will now be understood that customers in California and Florida may not require the enhanced heat exchanger 29, 34 or even the air circulating blower 35 to obtain the desirable features of the present invention. Other customers in colder climates may only order the circulating air blower 35 without the enhanced heat exchanger 29. In countries and climates which require the maximum efficiency because of the use of fuel or the cost of fuel can easily justify the cost of the enhanced heat exchanger and depending on the room space size and how the room space is insulated, may desire something less than the maximum burn rate in the environment in which the fireplace is placed. Thus, if a 26,000 BTU per hour fireplace is desired instead of 50,000 BTU per hour, the fireplace may be shipped to the customer with the optimum burn rate for the 26,000 rate already set using the diversionary damper plate 28 and a mid-range setting of the induced draft fan 19. After the fireplace 10 is installed and the length of the intake pipes 22A, and exhaust pipes 21 exceed a short or normal length, it is possible to optimize the burning rate of the burning system by adjusting the induced draft fan motor speed control means 55, also shown in FIG. 1, to achieve a optimum burner efficiency for the burner system at the desired burning rate even though the pressure drop across the combustion chamber 11 has been changed by the long pipe installation.

Having explained the preferred embodiment, it will now be understood that the fireplace system may be installed with up to 100 equivalent feet of intake and exhaust piping which permits the novel fireplace system to be installed on interior walls anywhere in an interior space such as apartments or condominiums as well as office buildings.

The preferred embodiment high efficiency heat exchanger 34 comprises a plurality of metal tubes which are expanded and tightly fitted through the panels at both ends. However, tubes 34 may be replaced with a rectangular plenum or passageway for the air to be heated which requires that the flanges on the plenum be lapped and sealed to prevent exhaust gases from entering into the preheated air which passes into the outer plenum 14A and is circulated to the outer plenum 12A before being exhausted from the top exit 16.

Having explained the flexibility of the present invention, it will now be understood that the basic box for the fireplace 10 may be mass produced and then custom fitted with a wide variety of glass panels or glass doors as well as a variation of heat exchangers and then optimized for burner efficiency before being shipped from the factory. Further, if the conditions in which the optimized burner efficiency fireplace 10 is installed create a condition other than a normal condition, the burner efficiency may be optimized again in the actual field environment for the optimum burner efficiency. It will be understood without explanation that the normal safety factors and safety system for controlling an induced draft system and a gas burner system are incorporated into the fireplace 10 but do not constitute a part of the present invention. Such devices are not explained herein but are commercially available and are explained in prior art patents such as our U.S. Pat. No. 4,424,792 and other patents referenced herein.

What is claimed is:

1. A variable high efficiency gas burner fireplace structure of the type adapted to be mounted on a wall of an interior space to be heated, comprising:

a box shaped fireplace structure having six walls comprising four substantially vertical walls, a top wall and a bottom wall, at least one of said four vertical walls having a glass side wall connected to the sides of said fireplace structure, the rear vertical wall of said fireplace structure being adapted to be mounted against a blind wall of said interior space to be heated, said rear wall said bottom wall and said top wall each having two plenums comprising an inner and an outer plenum wherein said outer plenums are interconnected to form a continuous U-shaped heat exchanger for circulating interior space air to be heated around a combustion chamber, a combustion chamber inside said inner plenums of said top wall, said rear wall, and said bottom wall and spaced away form said six walls, gas burner means in said combustion chamber, an exhaust gas passageway connected to said combustion chamber comprising said inner plenums of said top wall and said rear walls, combustion air inlet means connected to said combustion chamber below said burner means, air baffle means connected between said inner plenums of said bottom wall and said rear walls for adjusting the amount of combustion air bypassed from said inner plenum of said bottom wall into said exhaust gas passageway for optimizing the burner combustion efficiency and simultaneously cooling said exhaust gasses, and an induced draft fan/blower having an inlet connected to said exhaust gas passageway and an outlet connected to an exhaust pipe which extends outside said top wall or a side wall for producing a predetermined pressure drop across said combustion chamber and for creating an optimum gas burner efficiency.

2. A variable high efficiency fireplace structure as set forth in claim 1 wherein said induced draft fan/blower comprises a variable speed motor, and motor speed control means coupled to said induced draft fan/blower for setting the amount of induced draft pressure drop across said combustion chamber to optimize the burner combustion efficiency.

3. A variable high efficiency fireplace structure as set forth in claim 1 and an outer plenum and wherein said combustion air inlet means comprises said bottom wall inner plenum connected to a combustion air inlet passageway.

4. A variable high efficiency fireplace structure as set forth in claim 3 wherein said inner plenum of said bottom wall comprises an upper panel provided with a plurality of apertures therein for supplying said combustion air to said gas burner means.

5. A variable high efficiency fireplace structure as set forth in claim 1 wherein said induced draft fan/blower further comprises a variable speed motor, and motor speed control means coupled to said induced draft fan/blower for setting the amount of induced draft across said combustion chamber and for optimizing the burner combustion efficiency.

6. A variable high efficiency fireplace structure as set forth in claim 1 which further includes a removable air circulation blower in said U-shaped heat exchanger.

7. A variable high efficiency fireplace structure as set forth in claim 6 which further includes a high efficiency heat exchanger in said inner plenum of said rear wall for further heating room air circulating through said U-shaped heat exchanger.

8. A variable high efficiency fireplace structure as set forth in claim 7 wherein said high efficiency heat exchanger further comprises a plurality of heating tubes connected to a source of room air to be heated.

9. A variable high efficiency fireplace structure as set forth in claim 8 wherein said heating tubes conduct said room air through the tubes in a counterflow direction to said outer plenums.

10. A variable high efficiency fireplace structure as set forth in claim 8 wherein said high efficiency heat exchanger further comprises a horizontal plenum attached to the top panel of said inner plenum of said top wall in said exhaust passageway.

11. A variable high efficiency fireplace structure as set forth in claim 10 wherein said horizontal plenum is provided with inlet means coupled to the room air to be heated and outlet means coupled to the inlet of said heating tubes.

12. A variable high efficiency fireplace structure as set forth in claim 11 wherein the outlets of said heating tubes is connected to said outer plenum of said bottom wall.

13. A method of setting the efficiency of a burner system in a fireplace structure for optimum burner conditions, comprising the steps of:

providing a fireplace structure having a U-shaped heat exchanger surrounding a combustion chamber, providing an induced draft fan in the exhaust passageway which conduct the combustion gases leaving said combustion chamber, providing combustion air inlet means coupled to said combustion chamber, adjusting the amount of combustion air that is diverted from said combustion air inlet means directly into said exhaust passageway for adjusting a first optimum burner efficiency under standard factory conditions, and adjusting the speed of said induced draft fan in said exhaust passageways for providing a second and final optimum burner efficiency condition after said fireplace structure is installed in its intake and exhaust environment.

* * * * *